US007168432B1

(12) United States Patent
Brumfield

(10) Patent No.: US 7,168,432 B1
(45) Date of Patent: Jan. 30, 2007

(54) HAIRPIECE

(76) Inventor: Pamela Brumfield, 1056 W. 108th Pl., Chicago, IL (US) 60643

( * ) Notice: Subject to any disclaimer, the term of this patent is extended or adjusted under 35 U.S.C. 154(b) by 96 days.

(21) Appl. No.: 10/972,252

(22) Filed: Oct. 22, 2004

(51) Int. Cl.
*A41G 3/00* (2006.01)
*A41G 5/00* (2006.01)

(52) U.S. Cl. ..... 132/53; 132/201

(58) Field of Classification Search ..... 132/53, 132/278–284, 54–56, 275, 201, 276–277; D28/39–43, 92, 93
See application file for complete search history.

(56) References Cited

U.S. PATENT DOCUMENTS

| | | | | |
|---|---|---|---|---|
| 1,480,935 | A * | 1/1924 | Gleason | 132/278 |
| 2,165,716 | A * | 7/1939 | Molleson | 132/53 |
| 2,651,310 | A * | 9/1953 | Selson | 132/274 |
| 4,830,029 | A * | 5/1989 | Bird | 132/54 |
| 5,862,814 | A | 1/1999 | Janik | 132/275 |
| 5,890,498 | A * | 4/1999 | Kawaguchi | 132/275 |
| 5,899,211 | A | 5/1999 | Brown | 132/201 |
| 6,019,107 | A * | 2/2000 | Overmyer et al. | 132/53 |
| 6,311,699 | B1 | 11/2001 | Horman | 132/278 |
| D461,599 | S | 8/2002 | Albrecht | D28/42 |
| 6,634,366 | B1 * | 10/2003 | Simmons et al. | 132/53 |
| 6,830,054 | B1 * | 12/2004 | Ross-Kuehn | 132/201 |

* cited by examiner

*Primary Examiner*—John J. Wilson
*Assistant Examiner*—Robyn Doan
(74) *Attorney, Agent, or Firm*—Goldstein Law Offices, P.C.

(57) ABSTRACT

A hairpiece having a barrette having a plurality of elongated hair strands extending therefrom, for enhancing and augmenting the appearance of the existing hair of a wearer. The plurality of hairs which comprise the hairpiece extend from both the horizontal portions and a diagonal portion of a z-shaped track, thereby providing a hairpiece having a more realistic, contoured look. The hairpiece is particularly well suited for use by individuals who have experienced extreme hair loss from chemotherapy. The plurality of hairs of the hairpiece may be flat ironed, crimped, braided, or worn in a ponytail or other styles according to the aesthetic preferences of the wearer. The hairs of the hairpiece are human hairs, and may be shampooed, styled, and conditioned in the same manner as the wearer's own hair.

7 Claims, 3 Drawing Sheets

HAIRPIECE

BACKGROUND OF THE INVENTION

1. Field of the Invention

The invention generally relates to a hairpiece, and in particular relates to a hairpiece having a barrette having a plurality of elongated hair strands extending therefrom, for selective attachment to the existing hair of a user.

2. Description of the Related Art

Wigs and hairpieces are worn by millions of women worldwide in order to improve their appearance. Wigs are generally intended to be worn on top of a wearer's existing hair, and accordingly, cover a large part of the wearer's head. In contrast, hairpieces are generally designed to be secured to the wearer's own hair, and enable an individual with short or thinning hair to enjoy the look of long and luxurious hair without the need for covering a large part of the wearer's head with a wig. However, most available hairpieces suffer from several notable disadvantages. In particular, existing hairpieces are often constructed from synthetic fibers that are not natural looking. Moreover, many existing hairpieces are difficult to secure to the existing hair of an individual, especially for those individuals suffering from a condition such as alopecia which causes thinning hair. What's more, many hairpieces are not readily fashioned by a wearer into a variety of different and attractive hairstyles. Accordingly, there is a need for a hairpiece which looks natural because it is wholly fashioned from human hair, which is easily attachable to the existing hair of an individual with thinning hair by a "clip-on" barrette, and which has a plurality of hairs that may be easily fashioned by the wearer into a variety of different and attractive hairstyles.

A variety of artificial hairpieces have been devised for enhancing the appearance of a wearer. By way of example, U.S. Pat. No. 5,899,211 to Brown appears to show an artificial hairpiece having an independent extension of synthetic human hair secured at one end to a stretchable, twistable, and foldable elastic loop or band.

Additionally, a variety of barrettes and hair clips have been devised for sequestering portions of the existing hair of a user. For example, U.S. Pat. No. 5,862,814 to Janik appears to show a barrette having a plurality of attachment members for enabling a wearer to create a barrette that matches the wearer's outfit or color scheme. Additionally, U.S. Pat. No. D461,599 to Albrecht et al appears to show an ornamental design for a decorative hair barrette. Furthermore, U.S. Pat. No. 6,311,699 to Horman appears to show a ponytail holder comprising a hinged pair of first and second arms with first and second opposed elastic slings, wherein when the ponytail holder is closed on a bunch of hair, the opposed elastic slings extend to accommodate the thickness of the bunch of hair.

While these devices may be suitable for the particular purpose employed, or for general use, they would not be as suitable for the purposes of the present invention as disclosed hereafter.

SUMMARY OF THE INVENTION

It is an object of the invention to provide a hairpiece that is easily worn by a user. Accordingly, the hairpiece has a "clip-on" barrette that is easily attached onto a portion of the existing hair of the user.

It is another object of the invention to provide a hairpiece that is suitable for use by individuals who have experienced profound hair loss. Accordingly, after grouping the existing strands of hair, the barrette may be easily secured to thinning hair.

It is yet another object of the invention to provide a hairpiece that may be perfectly matched with the existing hair of any user. Accordingly, the plurality of hairs that comprise the hairpiece are provided in a wide variety of colors, textures, and thicknesses, in order that a user may choose a particular hairpiece which most closely matches the existing hair of the user.

It is still another object of the invention to provide a hairpiece having a realistic, contoured look. Accordingly, the plurality of hairs which comprise the hairpiece extend from both the horizontal portions and a diagonal portion of a z-shaped track, thereby providing a hairpiece having a more realistic, contoured look.

It is an additional object of the invention to provide a hairpiece that enhances the self-esteem of an individual who has experienced profound hair loss due to chemotherapy. Accordingly, the hairpiece greatly enhances the appearance of an individual who has experienced profound hair loss during chemotherapy, and thereby provides said individual with the self-esteem which is often lacking in individuals who have lost hair during chemotherapy.

It is yet another object of the invention to provide a hairpiece that is easily cleaned. Accordingly, because the hairs of the hairpiece are human hairs, the hairpiece may be shampooed, styled, and conditioned in the same manner as the wearer's own hair.

It is a further object of the invention to provide a hairpiece which may be easily styled according to the aesthetic preferences of a user. Accordingly, the long human hairs of the hairpiece may be flat ironed, crimped, braided, or worn in a ponytail, thereby providing a hairpiece which may be easily styled according to the aesthetic preferences of the user.

It is still another object of the invention to provide a hairpiece that is not unduly expensive. Accordingly, the materials from which the hairpiece is constructed are readily available, and its cost is not prohibitive.

Further objects of the invention will become apparent in the detailed description of the invention that follows.

The invention is a hairpiece having a barrette having a plurality of elongated hair strands extending therefrom, for enhancing and augmenting the appearance of the existing hair of a wearer. The plurality of hairs which comprise the hairpiece extend from both the horizontal portions and a diagonal portion of a z-shaped track, thereby providing a hairpiece having a more realistic, contoured look. The hairpiece is particularly well suited for use by individuals who have experienced extreme hair loss from chemotherapy. The plurality of hairs of the hairpiece may be flat ironed, crimped, braided, or worn in a ponytail or other styles according to the aesthetic preferences of the wearer. The hairs of the hairpiece are human hairs, and may be shampooed, styled, and conditioned in the same manner as the wearer's own hair.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
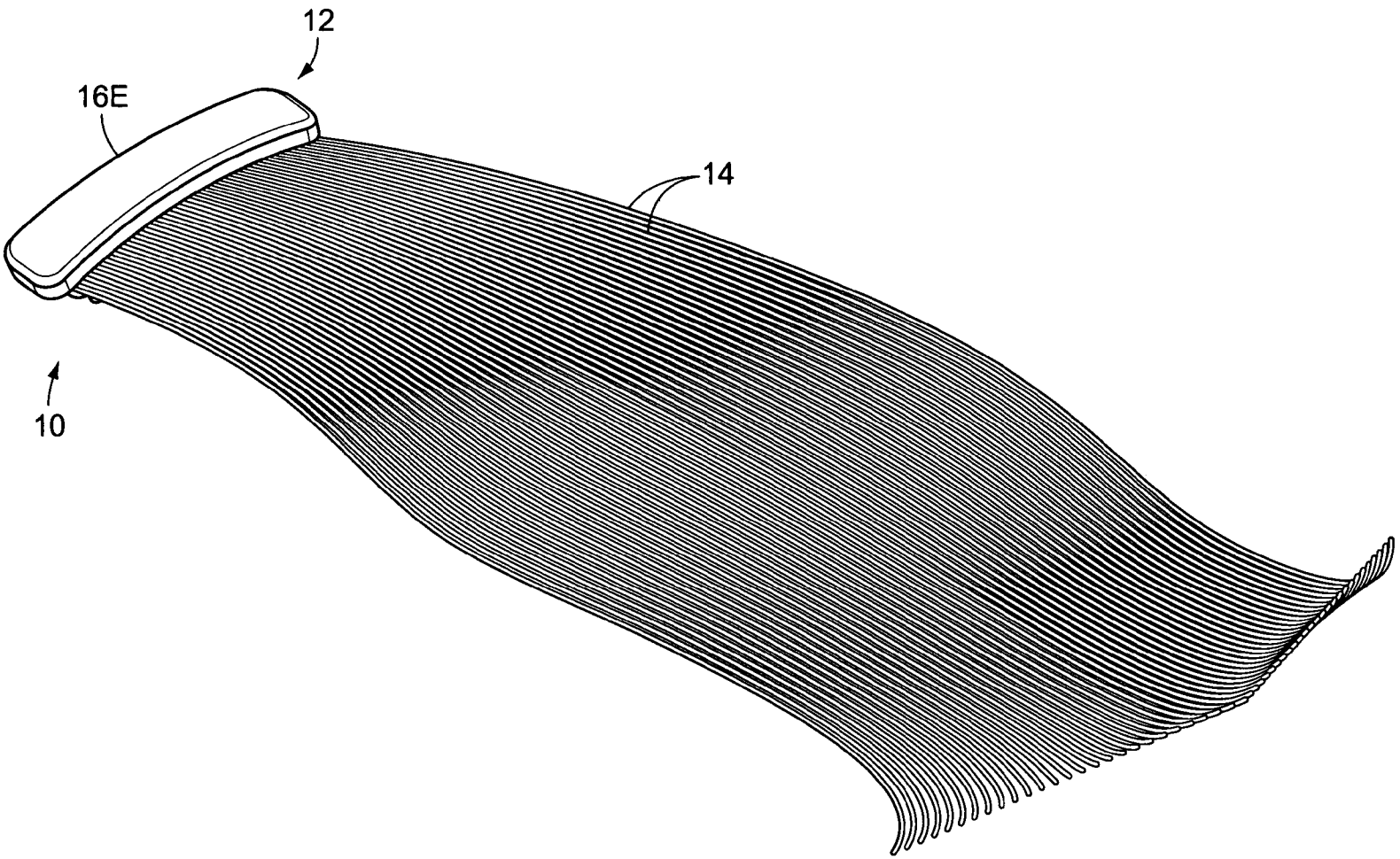
FIG. 1 is a perspective view of a hairpiece according to the present invention.

FIG. 1 illustrates a hairpiece 10, comprising a barrette 12 having a plurality of long hairs 14 extending therefrom. The barrette 12 is selectively attachable to the existing hairs of the head of a wearer of the hairpiece 10, by grouping a portion of the existing hairs and by clipping the barrette 12 onto the grouped portions of the hair. The hairpiece 10 enhances the appearance of the wearer by augmenting the appearance of the existing hair of the wearer.

Figure 2:
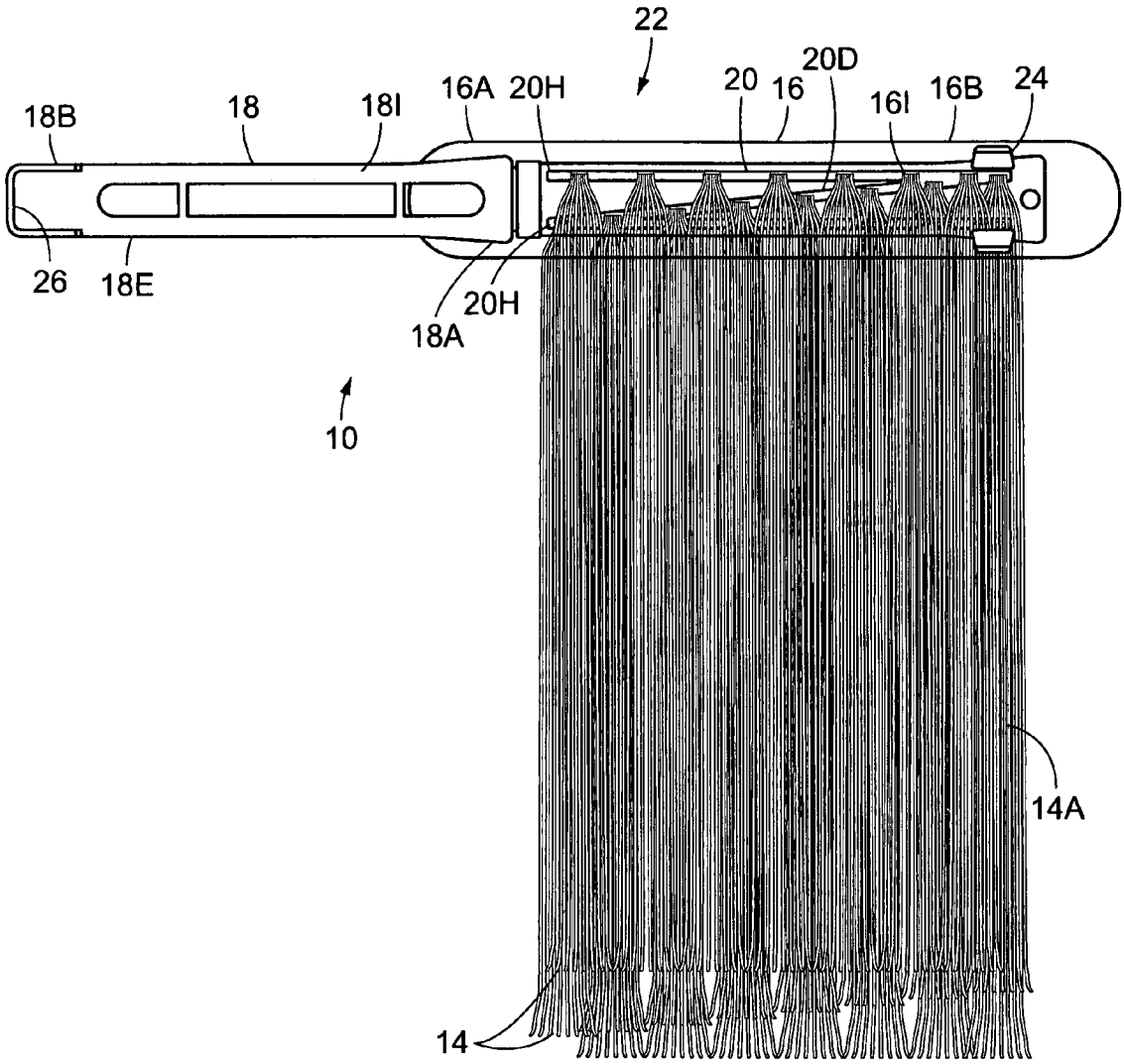
FIG. 2 is a perspective view of an inside surface of an upper crossmember of the hairpiece, illustrating a plurality of hairs extending from a z-shaped track.

Turning to FIG. 2, the barrette 12 has an elongated upper crossmember 16 and an elongated lower crossmember 18. The barrette 12 has an open position wherein the two crossmembers, 16 and 18, are pressed substantially flush against one another, as illustrated in FIG. 1. The barrette 12 also has a closed position wherein the two crossmembers, 16 and 18, have been extended away from one another, as illustrated in FIG. 2. The upper crossmember 16 has a first end 16A, a second end 16B, an inside surface 16I, and an outside surface 16E. Likewise, the lower crossmember 18 has a first end 18A, a second end 18B, an inside surface 18I, and an outside surface 18E. The upper crossmember 16 is connected to the lower crossmember 18 at a hinged junction 22. The hinged junction 22 may comprise a hinge pin which serves to pivotally attach the two crossmembers, 16 and 18. Alternately, the hinged junction 22 may simply comprise a thin flexible plastic connecting piece extending between the two crossmembers, 16 and 18, and which allows the two crossmembers, 16 and 18 to selectively swivel with respect to one another.

The inside surface 16I of the upper crossmember 16 of the barrette 12 has a tab 24 protruding outwardly therefrom, in proximity to the second end 16B. Correspondingly, the inside surface 18I of the lower crossmember 18 has an indented tab slot 26 extending inwardly therein, in proximity to the second end 18B. The tab slot 26 selectively engages the tab 24 of the upper crossmember 16 when the barrette 12 is closed, and thereby maintains the barrette 12 in the closed position.

The inside surface 16I of the upper crossmember 16 of the barrette 12 has a z-shaped track 20. The z-shaped track 20 having two horizontal portions 20H, parallel one another and connected by a diagonal portion 20D. The plurality of hairs 14 which comprise the hairpiece 10 loop around the z-shaped track 20 and extend downwardly from both the horizontal portions 20H and the diagonal portion 20D of the z-shaped track 20, thereby providing a hairpiece 10 with uneven lengths having a more realistic, contoured look. The hairs 14 each have a first end 14A which is rigidly secured to the z-shaped track 20 by a variety of methods such as are well known in the relevant art. Preferably, the first ends 14A of the hairs 14 taper inward and loop over both the horizontal portions 20H and the diagonal portion 20D and affix thereto by adhesive or other like material. Although, as illustrated, the z-shaped track 20 has two horizontal portions 20H connected by a single diagonal portion 20D, the number of the horizontal portions 20H and the diagonal portions 20D may be varied to adjust the extent of the contoured look provided by the hairpiece 10.

Figure 3:
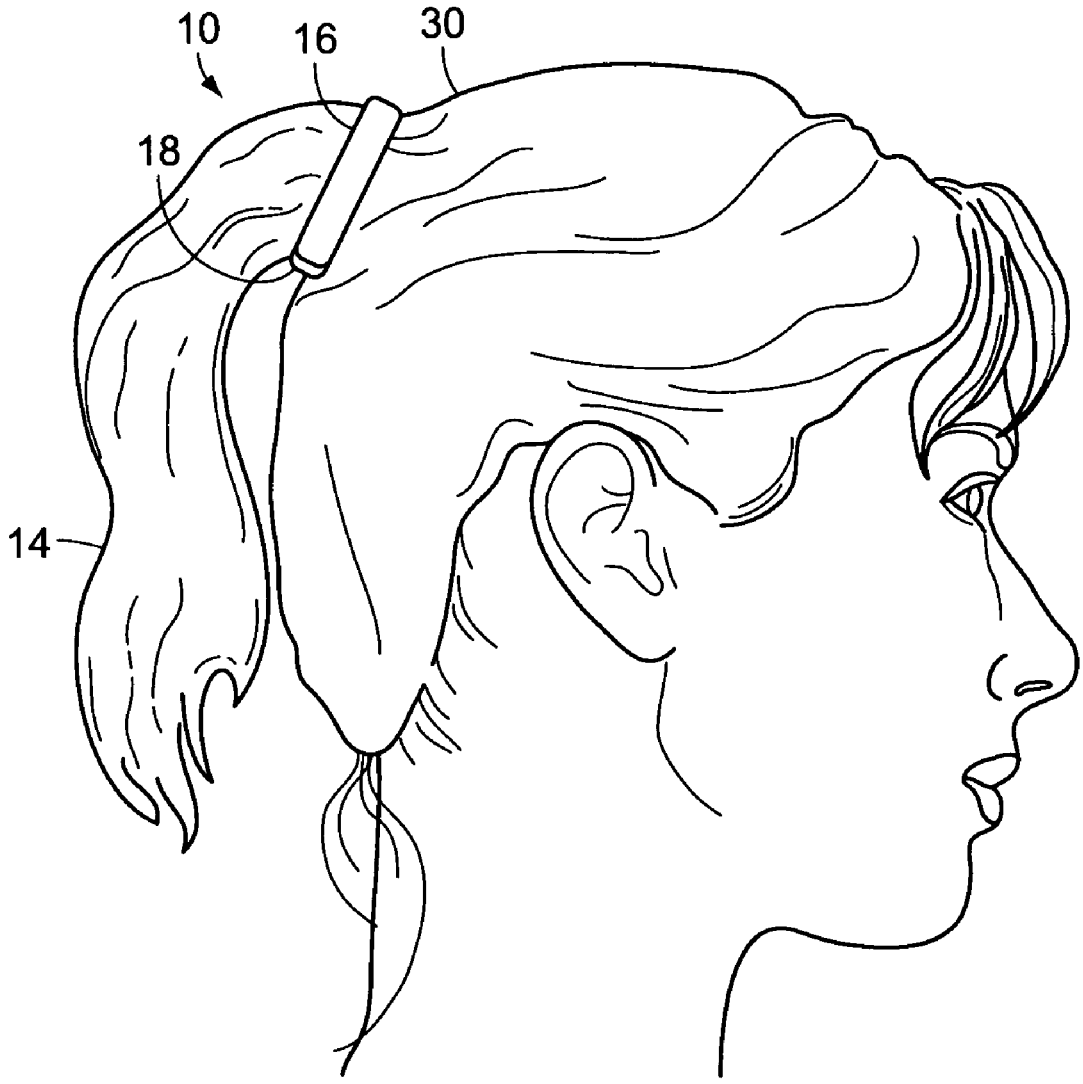
FIG. 3 is a perspective view of the hairpiece after selective attachment to the existing hair of a wearer.

FIG. 3 illustrates a perspective view of the hairpiece 10 after selective attachment to the existing hair 30 of a wearer. In particular, the wearer has grouped a portion of the existing hair 30 together, and has selectively fastened the barrette 12 to the grouped portion of hair 30.

The plurality of individual hairs 14 which comprise the hairpiece 10 are human hairs, and thereby provide a hairpiece 10 which "blends in" with the existing hair 30 of the wearer. The individual hairs 14 of the hairpiece 10 are provided in a wide range of colors, textures, and thicknesses, thereby allowing the wearer to choose a hairpiece 10 which closely matches the existing hair 30 of the wearer, in order to make it less apparent to an observer that the hairpiece 10 is not the wearer's own hair 30. Moreover, the colors of the individual hairs 14 of the hairpiece 10 are chosen to match the wide variety of existing hair colorants which are commercially available, thereby allowing the wearer to die her own hair 30 in order to match the colors of the hairs 14 of the hairpiece 10. Because the hairs 14 of the hairpiece 10 are human hairs, the hairpiece 10 may be periodically washed, shampooed, and conditioned as needed, in much the same way as the wearer would wash, shampoo, and condition the wearer's own hair 30. Furthermore, it is contemplated that the hairpiece 10 will be provided in different "ethnic versions". For example, a version of the hairpiece 10 having hairs 14 that are curly, black, and thick may be suitably used by African-Americans. Alternately, Asian Americans may suitably use a version of the hairpiece 10 having hairs 14 that are straight, black, and thick. Although the hairpiece 10 is well suited for use by women, it is also suited for use by men, especially by men having long hair.

The barrette 12 is provided in a variety of shapes and designs in order that the hairpiece 10 may be suitably worn for different occasions. Additionally, the barrette 12 is selectively provided in colors that match the colors of the hairs 14 extending therefrom, thereby providing a hairpiece 10 having a sleek, color-coordinated look. Although, as described, the hairpiece 10 is directly appended to the existing hair 30 of a wearer, it is contemplated that the hairpiece 10 may be suitably used even by a wearer who has lost almost all of her hair 30. Such an individual may clip the barrette 12 to the interior of an existing hat such as a baseball cap. The long hairs 14 may then be extended by the wearer out from the opening which is typically located at the back of the baseball cap, in order to provide an illusion of a full head of hair.

In use, a wearer purchases a hairpiece 10 according to the aesthetic preferences of the wearer. Generally, the chosen hairpiece 10 will have a color and texture which matches the color and texture of the existing hair 30 of the wearer. The wearer next gathers the wearer's own hair 30 together as if creating a ponytail, and secures the hairpiece 10 to the wearer's existing hair 30 with the barrette 12. The wearer then uses the fingers of the wearer to "blend" the ends of the existing hair 30 with the hairs 14 of the hairpiece 10, and thereby creates an illusion that the hairpiece 10 is part of the wearer's own hair 30. After wearing the hairpiece 10 on a number of occasions, the hairpiece 10 may be washed, shampooed, and conditioned, in much the same manner as the wearer would wash, shampoo, and condition the wearer's own hair. When finished using the hairpiece 10 on a particular occasion, the wearer removes the hairpiece 10 from the existing hair 30 of the wearer after first opening the barrette 12, and stores the hairpiece 10 until once again needed.

In conclusion, herein is presented a hairpiece having a barrette having a plurality of elongated hair strands extending therefrom, for selective attachment to the existing hair of a user. The invention is illustrated by example in the drawing figures, and throughout the written description. It should be understood that numerous variations are possible, while adhering to the inventive concept. Such variations are contemplated as being a part of the present invention.

What is claimed is:

1. A hairpiece, for augmenting the appearance of the existing hair of a wearer of the hairpiece, comprising:

a barrette which is selectively attachable to the existing hair of the wearer, having an elongated upper crossmember and an elongated lower crossmember, each having a first end, a second end, an inside surface, and a closed position, wherein the upper crossmember is connected to the lower crossmember at a hinged junction, said barrette having a closed position wherein the two crossmembers are pressed substantially flush against one another, and an open position wherein the two crossmembers have been extended away from one another; and a z-shaped track attached to the inside surface of at least one of the crossmembers of the barrette, said z-shaped track having at least two horizontal portions and at least one diagonal portion extending therebetween, each of said portions having a plurality of hairs extending therefrom, thereby providing a hairpiece having a more realistic, contoured look.

2. The hairpiece as recited in claim 1, wherein the z-shaped track is attached to the inside surface of the upper crossmember of the barrette.

3. The hairpiece as recited in claim 2, wherein the plurality of individual hairs which comprise the hairpiece are human hairs, thereby providing a hairpiece which blends in with the existing hair of the wearer, and which may be periodically washed, shampooed, and conditioned.

4. The hairpiece as recited in claim 3, wherein the inside surface of the upper crossmember of the barrette has a tab protruding outwardly therefrom, in proximity to the second end, and wherein, correspondingly, the inside surface of the lower crossmember has an indented tab slot extending inwardly therein, in proximity to the second end, said tab slot for selectively engaging the tab of the upper crossmember when the barrette is in the closed position.

5. The hairpiece as recited in claim 4, wherein the hinged junction comprises a flexible connecting piece extending between the two crossmembers and which allows the two crossmembers to selectively swivel with respect to one another.

6. The hairpiece as recited in claim 4, wherein the hinged junction comprises a hinge pin which pivotally attaches the two crossmembers.

7. A method for augmenting the appearance of the existing hair of a user, said method utilizing a hairpiece of claim 1, said method comprising the steps of:

gathering a discrete portion of the existing hair together;

securing the hairpiece to said portion of the wearer's existing hair with the barrette;

using the fingers of the wearer to blend the existing hair with the hairs of the hairpiece, and thereby creating an illusion that the hairpiece is part of the existing hair;

washing and conditioning the hairpiece when it becomes dirty;

removing the hairpiece from the existing hair of the wearer after first opening the barrette; and storing the hairpiece until once again needed.

* * * * *